US009752292B2

(12) United States Patent
Cacciotti

(10) Patent No.: US 9,752,292 B2
(45) Date of Patent: Sep. 5, 2017

(54) MULTI-PURPOSE MODULE FOR CLEANING THE ROAD PLATFORM AFTER CAR ACCIDENTS, IN ORDER TO RE-ESTABLISH SAFE AND PRACTICABLE ROAD CONDITIONS

(71) Applicant: Angelo Cacciotti, Rome (IT)

(72) Inventor: Angelo Cacciotti, Rome (IT)

(73) Assignee: SICUREZZA E AMBIENTE S.P.A., Rome (IT)

( * ) Notice: Subject to any disclaimer, the term of this patent is extended or adjusted under 35 U.S.C. 154(b) by 294 days.

(21) Appl. No.: 14/434,747

(22) PCT Filed: Aug. 6, 2013

(86) PCT No.: PCT/EP2013/066466

§ 371 (c)(1),
(2) Date: Apr. 9, 2015

(87) PCT Pub. No.: WO2014/056647

PCT Pub. Date: Apr. 17, 2014

(65) Prior Publication Data

US 2015/0267365 A1 Sep. 24, 2015

(30) Foreign Application Priority Data

Oct. 9, 2012 (IT) ..... 2012A0479

(51) Int. Cl.
*E01H 1/10* (2006.01)
*E01H 1/00* (2006.01)

(52) U.S. Cl.
CPC ..... *E01H 1/103* (2013.01); *E01H 1/001* (2013.01)

(58) Field of Classification Search
CPC .. A47L 11/34; A47L 11/4088; A47L 11/4083; A47L 11/4016; A47L 11/30;
(Continued)

(56) References Cited

U.S. PATENT DOCUMENTS 5,165,139 A * 11/1992 Oxman ..... A47L 11/34 15/321
5,704,989 A * 1/1998 Page ..... A47L 11/34 134/10

FOREIGN PATENT DOCUMENTS

| | | |
|---|---|---|
| DE | 8700123 | 3/1987 |
| EP | 2431102 A1 | 3/2012 |
| GB | 2465675 | 6/2010 |

* cited by examiner

*Primary Examiner* — Robert Scruggs

(57) ABSTRACT

A vehicle for re-establishing safe roadway conditions after a car accident by cleaning the roadway. The vehicle includes a first tank containing clean water; a second tank containing a washing liquid for washing oil and other fluids off the road; and a suction tank containing emulsion obtained by collecting the washing liquid and the oil materials. The vehicle also includes a high-pressure water gun; a suction system for removing the emulsion from the roadway; and a suction tube for removing debris from the road, such as broken glass and pieces of plastic. The high-pressure water gun and suction system are powered by an internal combustion engine which powers a pump and three-way distributor which pumps pressurized oil through a hydraulic circuit. There is also a level sensor to measure the quantity of liquid in the suction tank so that the combustion engine is switched off when suction tank is full.

7 Claims, 3 Drawing Sheets

(58) Field of Classification Search
CPC ..... A47L 13/17; A47L 13/22; E01H 1/001;
E01H 1/103
See application file for complete search history.

MULTI-PURPOSE MODULE FOR CLEANING THE ROAD PLATFORM AFTER CAR ACCIDENTS, IN ORDER TO RE-ESTABLISH SAFE AND PRACTICABLE ROAD CONDITIONS

The present invention relates to a multi-purpose module, preferably installed on a truck or on any commercial vehicle, that is specifically equipped in order to provide the best support in the activities for re-establishment of safe and practicable road conditions, after car accidents, through cleaning of the road platform.

More in particular, said module is able to support the re-establishment of safe and practicable road conditions using some specific devices installed on it, and to prevent, even in serious accidents, further damage to the environment. This is possible because it supports the cleaning of the road platform and the aspiration of functional polluting liquids (lubricating oils, fuels, cooling liquids, etc.) possibly lost by vehicles involved in the accidents. Further, the road platform is subject to a treatment using specific products, so that it is avoided any slippery surface; then, the solid debris related to typical car equipments (broken glasses, parts made of plastic, metals, remaining parts of structures, etc.) are collected and removed.

Therefore, the use of this multi-purpose module is particularly effective even in case of particularly serious road accidents, because it can support the interventions with specific devices providing a jet of a water solution and other devices having a high aspiration power. The water solution further contains specific products able to remove any slippery condition of surfaces, like the ecological surfactant and the molecular chain destroyer; these specific devices can further collect and contain the solid debris lost by vehicles involved in the accidents; and the emergency vehicles are equipped in order to reach the sites of accidents very quickly.

From the state of the art, some specific vehicles are known in order to collect the polluting substances lost on the road platform, after car accidents. In particular, the multi-purpose module of the present invention represents an improvement of the module disclosed in the European patent application EP 10425302. The above application is related to a multi-purpose module for re-establishment of safe and practicable road conditions, through cleaning of the road platform, comprising:

- three tanks for containing: clean water; a water solution composed of a ecological surfactant and a molecular chain destroyer; and an emulsion obtained by washing the road platform;
- a high-pressure water gun, including a rain jet adjustment, providing a jet of the above said solution on the road platform, where the polluting functional liquids have been eventually lost;
- a suction system suitable to collect and remove the above resulting emulsion, obtained from the polluting materials mixed to the washing/treatment solution, and solid debris lost by vehicles on the road platform;
- an hydraulic system wherein the power supply is directly provided by the engine and/or any other point of the kinematic chain of the vehicle, otherwise it is directly provided by a pneumatic or fluid dynamic circuit previously installed on the vehicle; in the latter case the system of energy transmission can include means of energy extraction, connected through one or more derivation points to the preinstalled circuit, that is activated by the engine of the same vehicle, and means of energy transmission towards a secondary hydraulic or fluid dynamic circuit supplying said high-pressure water gun and suction system; said derivation points include a three ways distributor extracting the energy from the circuit and transmitting it alternatively to the hydraulic engine, activating the water gun, and to the hydraulic or pneumatic engine activating the suction system; the water jet device pushes and directs the specific washing liquid under high pressure from the tank where it is contained to the water gun, and it is directed and sprayed with a high pressure on the road platform by an operator; the suction device aspirates the air from said tank leading it to a vacuum condition, so that the terminal of the suction device is directed by an operator in order to remove said resulting emulsion from the road platform and collect it inside the same tank.

However, the module of patent application EP 10425302 presents some specific drawbacks. First of all, it is not included a mechanism controlling automatically the level of filling of the vacuum tank, wherein the emulsion and debris are collected from the road platform. In fact, if the liquid collected into said tank reaches and goes beyond a specific maximum level, there is the risk to aspirate air mixed to wet particles and/or polluting particles, until the extreme situation when the liquid contained inside could be directly aspirated. In such a case, air mixed to a liquid would reach the engine leading to a risk of serious damage and/or a the final breakdown.

Another drawback is represented by the missing of a drying system operating on the road platform, to be used after the washing procedure, in order to dry up the surface quickly and properly and permit the fast re-establishment of the normal traffic conditions.

A third drawback is given by the temperature of the oil in the oil-dynamic system. In fact, the oil flows in the system and warms up due to the friction, reaching temperatures that are very high and dangerous. Therefore, the high temperature oil can break down the hydraulic engines that supply the water pump and the vacuum pump that make it possible to activate the water gun and the suction device.

Another drawback is related to the opening of the drain valve in the tank collecting the aspirated materials, that could be very small leading to a slow rate of the emptying process when the materials are delivered to disposal and recycle plants.

Another drawback is given by the aspirating hose having a big cross-section size, leading to a slow rate of aspiration decreasing therefore the aspiration power.

In order to overcome the above said drawbacks, the existing multi-purpose module has been improved by introduction of specific technical solutions, that have permitted to achieve improved efficiency and effectiveness of the same module.

Therefore, the main objective of the present invention is to propose a multi-purpose module that is perfectly autonomous from an energetic point of view, because there is an embedded engine that power supplies the entire system, the same module is used to support the re-establishment of safe and practicable road conditions after car accidents through cleaning of the road platform by a process of aspiration and collection of polluting liquids and other debris possibly lost by vehicles in the accident.

Another objective is to include a safety system in the multi-purpose module, manual and automatic, in order to control the filling of the tank, in order to avoid that the aspirated liquid collected into the tank goes beyond a specific quantity, so that it is prevented the aspiration of liquids towards the engines that could lead to a serious damage of the aspiration circuit and damage of the same engines.

Another objective is to include a drying system working with environmental air in order to dry up the road platform that has been previously washed, in order to re-establish very quickly extremely safe road conditions.

Another further objective is to place properly the oil tank in order to control the oil temperature, and therefore the cooling process, that is necessary in order to avoid that the oil circulating in the oil-dynamic circuit could damage and/or breaks down the hydraulic engines, that power supply the water pump and the suction device.

Another further objective is to increase the energetic performance of the entire system by intervention on the derivation points providing oil to the hydraulic engines.

Another objective is to improve the draining of the aspirated materials by including a proper drain valve in the tank where they are collected.

Another further objective is to increase the aspiration power, by achieving a proper cross-section of the aspiration hoses.

Therefore, it is specific subject of the present invention a multi-purpose module, preferably installed on a light commercial vehicle, for re-establishment of safe and practicable road conditions, after car accidents, through cleaning of the road platform, said vehicle being equipped by:

- a tank containing clean water; a tank containing water mixed to a specific washing liquid (ecological surfactant) and a specific treatment liquid for the road platform (so called molecular chain destroyer, to be sprayed on the oil and oil related products); a suction tank containing emulsion obtained by collection of the washing/treatment liquids and the polluting oil materials;
- a high-pressure water gun, including a rain jet adjustment, providing a jet of the above said solution on the road platform, where polluting functional liquids (lubricating oils, fuels, cooling substances, etc.) have been eventually lost by vehicles as a consequence of car accidents or breakdown;
- a suction system suitable to remove, from the road platform, the above resulting emulsion, obtained from polluting materials mixed to the washing/treatment solution; furthermore, through the terminal element or suction tube, solid and not biodegradable debris are removed/aspirated, these debris being related to typical car equipments (broken glasses, parts made of plastic, metals, remaining parts of structures, etc.), characterized in that further comprising:

- an internal combustion engine which, through a double oil-dynamic pump and a three-way distributor, pushes the pressurized oil contained in a hydraulic circuit, allowing its motion in direction of two hydraulic motors, that are required to operate both said high-pressure water gun and said suction system;
- a sensor of level (electrolevel) measuring the quantity of liquid in said tank that, when said level exceeds a maximum capacity allowed, is able to switch off said combustion engine.

According to another aspect of the present invention, the multi-purpose module could further comprise in addition:

- a GPS system (Global Positioning System), that is a satellite system for detecting the geographical position, having an electronic circuit activated by the ON position switched on the control panel of the module; said GPS system further comprises communication means using a SIM card to allow the transmission of data, through a network of mobile and/or wireless communication, to a national Headquarter, such data relating to geographical coordinates of the vehicle and time of its arrival on the place of the accident.

The present invention will now be described for illustrative but non-limiting purposes, according to its preferred embodiments, with particular reference to figures of the enclosed drawings, wherein.

It is here underlined that, in the following, only some of the many conceivable embodiments of the present invention will be described, and that they are just some particular examples that do not introduce any limitations, having the possibility to describe many other embodiments based on the disclosed technical solutions of the present invention.

Figure 1:
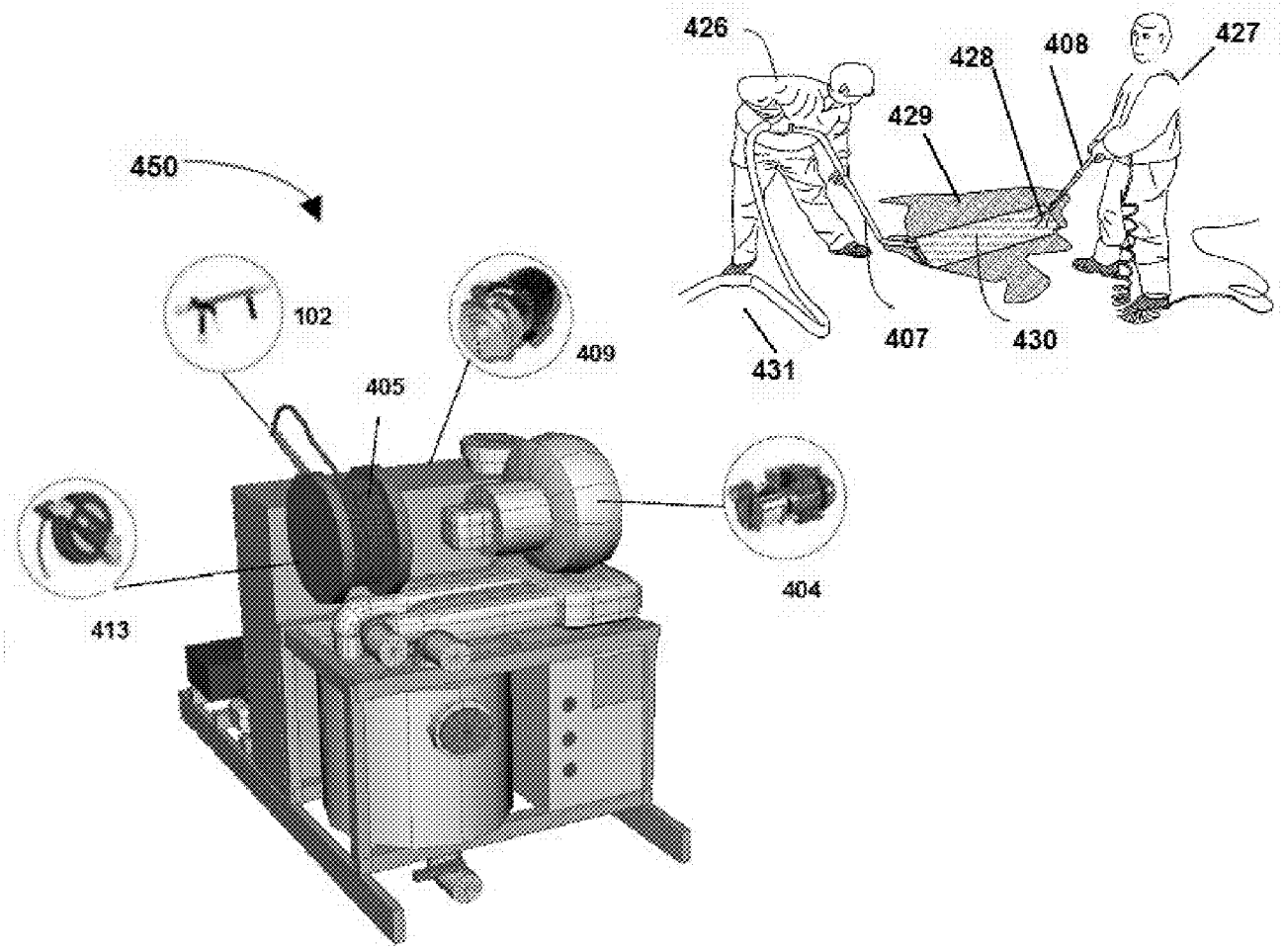
FIG. 1 shows a perspective view of a multi-purpose module for re-establishment of safe and practicable road conditions, preferably installed on a commercial vehicle, with a schematic view of the cleaning intervention.

In FIG. 1 it is represented a multi-purpose module 450 for re-establishment of safe and practicable road conditions, after car accidents, through cleaning of the road platform.

The multi-purpose module 450 is composed of the following fundamental components:

- a tank 415 containing clean water; a tank 414 containing a solution 428 of water mixed to a specific washing liquid—ecological surfactant—and a specific treatment liquid for the road platform—so called molecular chain destroyer to be sprayed on oil and related oil products; a suction tank 405 containing emulsion 430 obtained by collection of the washing/treatment liquids and the polluting oil materials;
- a high-pressure water gun 408, including a rain jet adjustment, providing a jet of the above said solution 428 on the road platform, where polluting functional liquids 429—lubricating oils, fuels, cooling substances, etc., have been eventually lost by vehicles as a consequence of car accidents or breakdown;
- a suction system 431 suitable to remove, from the road platform, the above resulting emulsion 430, obtained from polluting materials 429 mixed to the washing/treatment solution 428; furthermore, through the terminal element or suction tube 407, solid and not biodegradable debris are removed/aspirated, these debris being related to typical car equipments—broken glasses, parts made of plastic, metals, remaining parts of structures, etc.

The cleaning process starts when the connection pipes are installed, connecting the terminal devices of the hydraulic circuit to respective independent tanks, 414, 415, 405, placed on module 450.

The operator 426 (possibly assisted by a second operator 427) can start the operations of cleaning the road platform and related parts on which there are polluting liquids and/or other not biodegradable materials. As a priority, the same operator 426 will remove immediately, using the suction system 407, most of the existing polluting liquids 429 lost by vehicles in the accident, then he will wash the road platform using a solution of water and specific products 428 (ecological surfactant and molecular chain destroyer). This solution is sprayed using a high-pressure water gun, including a rain jet adjustment, 408, so that the polluting material 429 is removed from the platform, avoiding any slippery condition, and it is activated a degradation process of hydrocarbons provided by natural bacteria, washing the road platform at the same time.

Finally, the resulting emulsion 430 is aspirated and collected in the proper container 405, and then temporary stocked at the site of the company that made the intervention, before to be definitely delivered to special and authorized plants, where they are processed and properly finished as required by the existent environmental laws.

Figure 2:
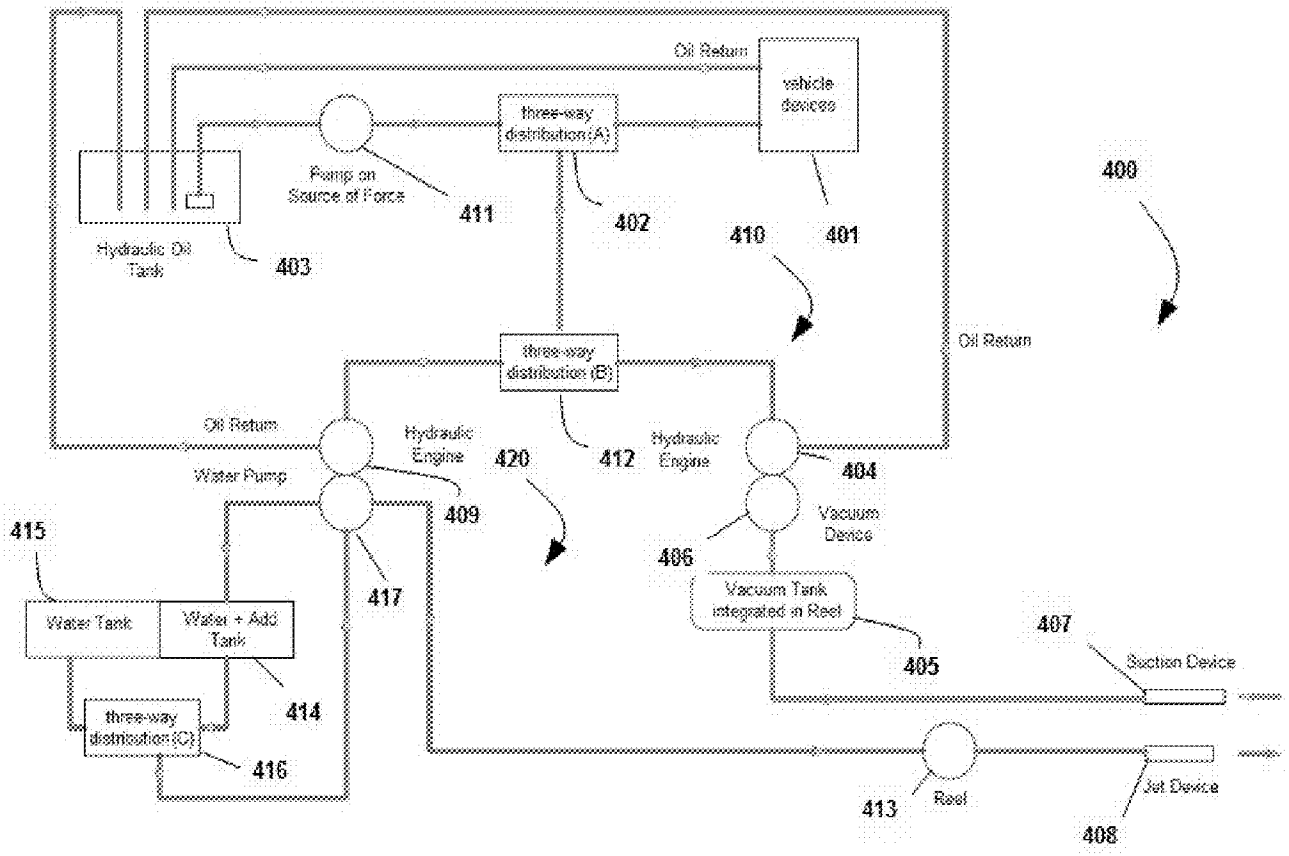
(prior art) Fig. 2
FIG. 2 shows a schematic view of a hydraulic system according to the prior art, that extracts energy directly from the engine of the truck, in order to power supply the water jet device that can spray water mixed to other washing substances, and the suction device that aspirates the resulting emulsion and the solid debris eventually lost by vehicles.

In FIG. 2 it is illustrated the hydraulic system 400 according to the prior art, where the power supply, necessary to make the multi-purpose module to work properly, can be directly provided by the engine and/or any other point of energy transmission in the kinematic chain. The extracted energy can be therefore used as a power supply for mechanical, electrical or hydraulic devices.

In case that the vehicle on which it is placed the multi-purpose module has a pneumatic circuit previously installed on it, like in example in case of trucks equipped for transportation of vehicles having a mechanical arm or a load platform with a variable orientation, then the above energy transmission system can be achieved in a different way. Using a three-ways distributor 412, the energy can be provided to the hydraulic engine 409 of the water pump 417 and to the hydraulic engine 404 of the vacuum pump 406.

Figure 3:
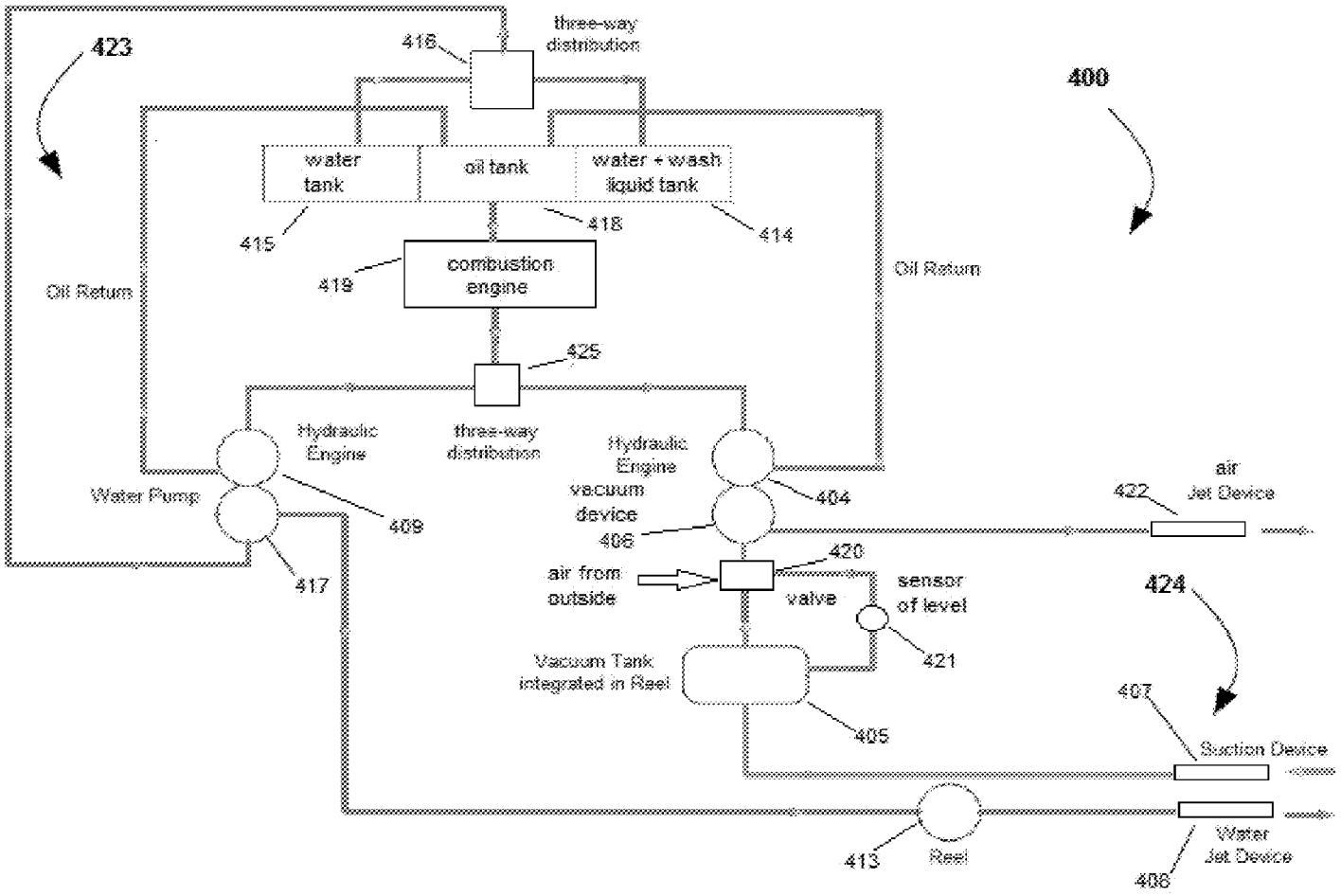
FIG. 3 shows a schematic view of a hydraulic system according to the invention, wherein the energy, necessary to power supply the water jet device and the suction device, is not extracted from the engine of the truck but it is given by an autonomous combustion engine, able to make the hydraulic engines able to work for the water pump and the vacuum pump.

FIG. 3 shows a hydraulic system 400 according to the present invention, where the multi-purpose module is autonomous in respect to the engine of the truck, because a combustion engine 419 provides energy to the entire system, pushing oil from tank 418 in circulation into the hydraulic circuit. Therefore, the combustion engine 419 makes it possible to use the module as an autonomous device, independently from the vehicle on which it is transported, achieving then an improved possibility of transportation and use, avoiding at the same time to overload or damage the components of the vehicle and/or the wasting of fuel.

The combustion engine 419, through the distributor 425, pushes oil towards the hydraulic engine 409, that in turn activates the water pump 417, and at the same time pushes oil towards the hydraulic engine 404, that in turn activates the vacuum pump 406.

The specific washing liquid (molecular chain destroyer of oil and oil related products) is contained inside the tank 414 in its final composition. The hydraulic pump 417 pushes and directs the high-pressure liquid from tank 414 towards the water gun 408, from which it is sprayed directly, under control of an operator, on the road platform. The vacuum pump 406 extracts air from tank 405, creating a vacuum state inside, so that the suction system 407 can remove, under control of a second operator, the resulting emulsion from the road platform towards the tank 405.

The removed liquids are a mix of the previous washing liquids and other liquids and polluting materials having origin in petroleum, eventually lost by vehicles involved in the accident. They are aspirated and collected from the operator inside the tank 405. But also solid and not biodegradable debris are removed/aspirated, these debris being related to typical car equipments (broken glasses, parts made of plastic, metals, remaining parts of structures, etc.).

Therefore, a fundamental step of the cleaning process of the road platform is represented by the aspiration of polluting liquids lost by vehicles, by using the suction device 407. In a first improvement of the module, it has been imagined to use the air, aspirated from the vacuum tank 405 and usually lost in the environment, in order to dry up the previously washed road platform. However, it has been immediately recognized that the air inside the tank 405 usually contains a significant amount of humidity, because it is in contact with the emulsion aspirated from the road platform comprising a mix of the washing solution and the polluting liquids; therefore its use could be very dangerous because it could damage the components of the machine. In order to overcome this problem it has been proposed to include a valve 420 before the aspiration circuit 424; said valve 420 can be switched manually by the operator, changing the point of extraction of air from inside the tank 405 to the external environment. In such a way, the air used to dry up the road is not characterized by humidity and pollution like that contained in the vacuum tank 405, but it is a dry and clean air because it is originated from the outer environment, introducing significant advantages arising from the effectiveness of the drying process in order to avoid that wet air could reach the vacuum device 406 leading to serious damage or a final break down of the machine.

Usually, the valve 420 is a spherical valve that can be switched manually. When the emulsion has been collected completely, and then the operator recognizes that the aspiration process is no more necessary, the same operator could switch manually the valve 420 in order to change the point of extraction of air; in this way, the entry point at the tank 405 is closed and the entry point at the outer environment is opened. Then, the air originated from the environment is directed to a hose 422 that, under control of the operator, directs the air to the road platform making it to dry up. The manual switch of valve 420 is very useful even during the ordinary maintenance of the vacuum device 406, because it allows a continuous exchange of air: in fact the aspiration of the environmental air through the aspiration circuit 424 decreases the quantity of humidity and/or possible polluting particles that could have been entrapped in the same circuit 424. For a better safety, it has been further proposed to include an automatic sensor of level 421, a so called electrolevel, together with the valve 420. The electrolevel 421 includes a control electronics that, when a maximum level of liquid contained in tank 405 has been reached, automatically generates a control signal that switches off the combustion engine and causes the switching off of the aspiration circuit, because the oil results to be no more pressurized.

Therefore, the sensor level is extremely important, because it represents a safety device during the filling process of the tank 405. If a sensor of level 421 would be not available, it could happen that the operator does not realize that liquid has reached the highest possible level inside the tank, therefore the aspiration circuit would continue to aspirate wet air until, in case of tank 405 totally full, would start to aspirate the liquid collected inside. This would be a huge problem, because the liquid could reach the vacuum device and cause serious damage, up to the final break down of the machine. Instead, the mechanism activated by the sensor of level 421 would switch off the combustion engine, interrupting the aspiration process when the tank 405 has been filled up to a maximum level; it is achieved therefore the switching off of the aspiration process avoiding any unexpected aspiration of wet air or aspiration of the same collected liquids. Therefore, serious damages are avoided to the components of the entire aspiration circuit 424, that has been designed and built only to be used with dry air.

In addition to the tank containing air and washing liquids 414, another tank is installed containing just pure water, accessible though a three way valve 416. The pure water is useful in order to dilute the water solutions, or in order to alternate different washing steps, with specific washing liquids (ecological surfactant and molecular chain destroyer) and without specific washing liquids. Then, a third tank 418, containing just oil of the oil-dynamic circuit, is placed between the tank 415 of pure water and the tank 414 of water mixed to washing liquids; therefore, a squared container composed of three compartments is achieved. That is another innovative feature of the present invention, that introduces some significant thermic advantages arising from the heat exchange between the water solutions, contained in the lateral tanks 415 and 414, and the pressurized oil, contained in the central tank 418, belonging to the hydraulic circuit that activates the engines 404, 409. The heat exchange is achieved through the contact walls and through a cooling coil in which the oil flows; the latter one represents a real "radiator" because it passes through the tank of pure water 415 and/or the tank of water mixed to washing liquids 414. In such a way, the heat exchange between water and oil under pressure is faster and easier, leading to a double advantage: from one side it is achieved a proper cooling down of the oil, leading to a control of its temperature, necessary in order to avoid its warming up with consequent damage of engines and hydraulic pumps; on the other side it is achieved a useful warming up of water, increasing the effectiveness of its cleaning power during the washing process. As represented in FIG. 2, in the hydraulic system of the first version of the multi-purpose module disclosed in patent application EP 10425302, the two hydraulic engines 409 and 404 are connected to a single point of oil derivation. This because the oil is extracted from the oil tank 403 in the truck 403, and then directed to the hydraulic engines 409, 404 by a three ways distributor 412.

As represented in FIG. 3, in the improved multi-purpose module of the present invention there are two points of oil derivation, in order to power supply respectively the hydraulic engine 409 of the washing circuit 423 and the hydraulic engine 404 of the aspiration circuit 424, in such a way that each hydraulic engine 409 and 404 is connected to its own independent point of oil derivation. More exactly, the oil contained in the tank 418 is extracted from the combustion engine and double pump, and then pushed under pressure through the three ways valve 425 towards the hydraulic engine 409 and the hydraulic engine 404. From the main circuit just two derivations are originated: one in order to permit the functioning of the water gun 408 necessary for the washing process, and the other in order to permit the aspiration 407, necessary for the collection of liquids and debris from the road platform. The final result is an improved energetic performance.

The aspiration of liquids and debris from the road platform is a very critical operation, that should be completed as soon as possible, in order to clean very quickly the road and permit the normal circulation of traffic. For this reason it is very important that the module is characterized by a very high aspiration power. Therefore, another improvement in the machine has been given by the decrease of the cross-section of the aspiration hose 407, in respect to the prior art. In such a way it permits to increase the aspiration velocity and increase therefore the general aspiration power of the machine. The liquid and solid materials collected from the road platform are contained in the related tanks available in the module. They are temporary stocked in the plant of the company that provided the intervention, according to a specific operative protocol arising from the existing environmental laws, in order to be transported later to authorized disposal and recycle plants. In order to provide a fast and easy draining of said materials, when they are discharged to said plants, it has been increased the cross-section of the draining hose in the tank of collected materials 405.

Another important aspect, when a road accident happens, is to provide an immediate intervention.

In fact, it is necessary to reach quickly the site of the accident, in order to help people involved in the accident very quickly, and in order to re-establish normal traffic conditions. For this reason it is very important to detect the exact position of operators during the intervention procedures, and this detection is possible because the present module includes a GPS system (Global Positioning System) that is a system for detection of the geographic position by satellite. The GPS system is connected to the electronics in the control board of the combustion engine 419.

The position ON in the control board power supplies the electronic circuit of the GPS, enabling transmission to a national Headquarter of the geographical coordinates of the vehicle and its time of arrival on site of the accident. A connection by a SIM card permits the data transmission through a mobile and/or wireless telecommunication network.

Therefore, the switching ON of the machine power supplies the GPS system that transmits immediately and automatically the geographical position of the operators to a national Headquarter, permitting the supervision and the remote control of the road intervention activities and the periodic procedures of the machine maintenance.

During the cleaning operations many electrical devices are installed in the area, like in example the illumination lamps, therefore it is very important to provide the maximum protection to operators in front of possible electrical discharges. For this reason, the module includes a specific pincer electrically connected to the ground, so that all the elements are connected to a unique terminal on ground, in order to achieve the discharge of possible flowing electrical currents, increasing the safety of workers and the protection of the machine from damage.

Therefore, the above examples show that the present invention achieves all the proposed objectives. In particular, it permits to obtain a multi-purpose module that is perfectly autonomous from an energetic point of view, because there is an embedded engine that power supplies the entire system, the same module is used to support the re-establishment of safe and practicable road conditions after car accidents through cleaning of the road platform by a process of aspiration and collection of polluting liquids and other debris possibly lost by vehicles in the accident.

The same invention discloses a safety system in the multi-purpose module, manual and automatic, in order to control the filling of the tank, in order to avoid that the aspirated liquid collected into the tank goes beyond a specific quantity, so that it is prevented the aspiration of liquids towards the engines that could lead to a serious damage of the aspiration circuit and the same engines.

Furthermore, the multi-purpose module includes a drying system working with environmental air in order to dry up the road platform that has been previously washed, in order to re-establish extremely safe road conditions very quickly.

According to the invention, the oil tank is placed properly in order to control the oil temperature, and therefore the cooling process, that is necessary in order to avoid that the oil circulating in the oil-dynamic circuit could damage and/or breaks down the hydraulic engines, that power supply the water pump and the suction device.

Furthermore, the invention increases the energetic performance of the entire system by intervention on the derivation points providing oil to the hydraulic engines.

Then, it improves the draining of the aspirated materials by including a proper drain valve in the tank where they are collected.

Furthermore, the invention increases the aspiration power, by achieving a proper cross-section of the aspiration hoses.

Further according to the invention, the module includes a GPS system that is connected to the control panel of the machine; when the switch on the control panel is turned ON, the geographical coordinates are automatically transmitted to a national Headquarter through a mobile and/or wireless telecommunication network, achieving a localization of workers on site and a monitoring of the periodic maintenance operations.

Finally, the multi-purpose module includes a specific pincer that is electrically connected to the ground, so that all the elements are connected to a unique terminal on ground, in order to achieve the discharge of possible flowing electrical currents, increasing the safety of workers and the protection of the machine from damage. The present invention has been described for illustrative but non-limiting purposes, according to its preferred embodiments, but it is clear that modifications and/or changes can be introduced by those skilled in the art without departing from the relevant scope, as defined in the enclosed claims.

I claim:

1. A multi-purpose module (450), configured to be installable on a light commercial vehicle, for re-establishment of safe and practicable road conditions, after car accidents, through cleaning of the road platform, said vehicle comprising:

a tank (415) containing clean water; a tank (414) containing water mixed to a specific washing liquid—ecological surfactant—and a specific treatment liquid for the road platform—so called molecular chain destroyer, to be sprayed on oil and related oil products (428); a suction tank (405) containing emulsion (430) obtained by collection of the washing/treatment liquids and the polluting oil materials;

a high-pressure water gun (408), including a rain jet adjustment, providing a jet of the above said solution (428) on the road platform, where polluting functional liquids (429) have been eventually lost by vehicles as a consequence of car accidents or breakdown;

a suction system (431) suitable to remove, from the road platform, the above resulting emulsion (430), obtained from polluting materials mixed to the washing/treatment solution (428); the suction system further including a suction tube (407) for removing solid and not biodegradable debris from the car accident;

the vehicle further including:

an internal combustion engine (419) which, through a double oil-dynamic pump and a three-way distributor (425), pushes the pressurized oil contained in a hydraulic circuit, allowing its motion in direction of two hydraulic motors (404, 409), that are required to operate both said high-pressure water gun (408) and said suction system (431);

a level sensor configured to measure the quantity of liquid in said suction tank (405) such that, when contents in the suction tank reach a particular level, said level sensor is configured to switch off said combustion engine (419).

2. The multi-purpose module of claim 1 further comprising:

a GPS system (Global Positioning System), or a satellite system for detecting the geographical position, having an electronic circuit activated by the ON position switched on the control panel of the module (450); said GPS system further comprises communication means using a SIM card to allow the transmission of data, through a network of mobile and/or wireless communication, to an Headquarter, such data relating to geographical coordinates of the vehicle and time of its arrival on the place of accident.

3. The multi-purpose module of claim 1 further comprising:

an oil tank (418) belonging to said hydraulic circuit, positioned at the center between said tank (415) containing clean water and said tank (414) containing water mixed to a specific washing liquid and a specific treatment liquid, thus obtaining a tripartite parallelepiped tank, such as to determine a heat exchange through both the walls of contact and the walls of some serpentine tubes in which the oil flows; these serpentine tubes work as "radiators" because they are placed inside tank (415), containing clean water, and tank (414), containing water mixed to a specific washing liquid and a specific treatment liquid.

4. The multi-purpose module of claim 1 including: two source points of oil, connected respectively to said hydraulic motor (409) of the washing circuit (423) and to said hydraulic motor (404) of the suction circuit (424);

wherein each of said hydraulic motors (404, 409) is connected by its own source point, and only two branches are connected to the main circuit: one connected to the high-pressure water gun (408), necessary for washing, and another connected to the aspirator (407), necessary to remove polluting liquids (429) and debris.

5. The multi-purpose module of claim 1 wherein the diameter of the suction tube has been reduced compared to that of the prior art, in such a way to increase the speed of the suction process and therefore to improve the suction power of the suction system.

6. The multi-purpose module of claim 1 wherein the diameter of the drain pipe connected to the suction tank (405) has been increased compared to that of the prior art, in such a way to facilitate and speed up the flow of such materials, when they are discharged to treatment and/or disposal plants.

7. The multi-purpose module of claim 1 including: a terminal for electrical connection to ground, that allows to discharge any leakage of electrical current; all the electrical devices belonging to the multi-purpose module are connected to a unique and to the same circuit connected to ground, in such a way to give to the entire system a better safety against possible accidents to operators and to assure a better protection against damage to the components of the same module (450).

* * * * *